US005079776A

United States Patent [19]

Crawford

[11] Patent Number: 5,079,776

[45] Date of Patent: Jan. 14, 1992

[54] GLOVE FOR ROCK CLIMBING

[76] Inventor: David H. Crawford, P. O. Box 8005, Suite 404, Boulder, Colo. 80306-8005

[21] Appl. No.: 447,034

[22] Filed: Dec. 7, 1989

[51] Int. Cl.[5] ..... A41D 13/10

[52] U.S. Cl. ..... 2/20; 2/162; 2/167

[58] Field of Search ..... 36/113; 2/159, 161 R, 2/161 A, 162, 167, 168, 20, 16

[56] References Cited

U.S. PATENT DOCUMENTS

| | | | |
|---|---|---|---|
| 410,999 | 9/1889 | Young | 2/162 |
| 1,900,395 | 3/1933 | Gitt, Jr. | 2/162 X |
| 1,966,822 | 7/1934 | Lieb | 2/160 X |
| 2,075,550 | 3/1937 | Smith | 2/168 |
| 3,037,209 | 6/1962 | Applegate, Jr. et al. | 2/20 |
| 3,066,306 | 12/1962 | Thomas | 2/20 |
| 3,096,523 | 7/1963 | Bruchas | 2/159 |
| 3,606,614 | 9/1971 | Dimitroff | 2/159 |
| 4,071,913 | 2/1978 | Rector | 2/20 |
| 4,411,024 | 10/1983 | Hayes | 2/20 |
| 4,484,359 | 11/1984 | Tirinen | 2/20 |
| 4,497,072 | 2/1985 | Watanabe | 2/167 X |
| 4,531,241 | 7/1985 | Berger | 2/161 R |
| 4,561,122 | 12/1985 | Stanley et al. | 2/20 |
| 4,570,269 | 2/1986 | Berlese | 2/161 A |
| 4,624,016 | 11/1986 | Luevano | 2/161 A |
| 4,675,913 | 6/1987 | Rockwell | 2/161 R |
| 4,716,663 | 1/1988 | Steinhauser | 36/113 |
| 4,742,578 | 5/1988 | Seid | 2/25 |
| 4,754,499 | 7/1988 | Pirie | 2/20 |
| 4,768,234 | 9/1988 | Yamamoto | 2/161 A |
| 4,785,478 | 11/1988 | Mosley | 2/161 R |
| 4,785,479 | 11/1988 | Watanabe | 2/163 |
| 4,809,366 | 3/1989 | Pratt | 2/161 RX |

FOREIGN PATENT DOCUMENTS

| | | | |
|---|---|---|---|
| 2200198 | 7/1973 | Fed. Rep. of Germany | 2/161 R |
| 298879 | 10/1928 | United Kingdom | 36/113 |

OTHER PUBLICATIONS

Reno, *Charles Cole Talks About Rubber*, 24 Rock & Ice 54–56 (1988).

Coats, *A Quantitative Comparison of Rock Shoe Rubber*, 35 Rock & Ice 79–80 (1990).

*Primary Examiner*—Werner H. Schroeder
*Assistant Examiner*—Sara M. Current

[57] ABSTRACT

The present invention provides a glove for use in rock climbing. The glove includes a pad that, in the preferred embodiment, is made from a climbing rubber and adapted to cover the back and lower peripheral palm portioins of the climber's hand.

21 Claims, 8 Drawing Sheets

GLOVE FOR ROCK CLIMBING

FIELD OF THE INVENTION

This invention relates to a hand glove for use in rock climbing activities.

BACKGROUND OF THE INVENTION

In rock climbing, an outdoor sport that involves skillfully ascending rock cliffs using the hands and feet for balance and power, the climbers hands are used in a variety of positions to grip, hold and cling to the rock. There are two broad categories of rock climbing: face climbing and crack climbing. In face climbing, the climber primarily uses the fingertips and the palm of the hand to grasp features on the surface of a rock face. In contrast, the climber grasps or clings to the rock in crack climbing by inserting a hand into a crack and manipulating the hand so as to create normal forces between the hand and the interior surfaces of the crack that, in turn, create enough frictional force to allow ascension of the crack.

Two of the problems encountered when rock climbing bare-handed and especially during crack climbing are: (1) that the skin of the hand can become cut, scratched, bruised and/or abraded through contact with the rock; and (2) that the hand slips on the rock because of the relatively low frictional engagement between the skin of the hand and the rock due, among other things, to perspiration and the relatively low coefficient of friction between the hand and the rock.

To increase the frictional engagement between the hand and the rock, climbers have used gymnastic chalk to absorb perspiration. Unfortunately, as the climber's hand perspires the chalk becomes saturated and turns into a slick paste that reduces the frictional engagement between the climber's hand and the rock. While chalk does provide some increase in the frictional engagement between the hand and the rock, it does not offer any protection from cuts, scratches, bruises and/or abrasions resulting from the hand contacting th rock.

One way to protect the skin of the hand and reduce hand slippage is to wrap the hand with medical adhesive tape. Among the problems associated with taping the hand are: (1) the tape only offers a moderate improvement over bare-handed climbing with respect to the prevention of cuts, scratches, bruises, and/or abrasions; (2) the frictional engagement between the tape and the rock is not much better than that of bare skin; (3) the tape inhibits the climber's ability to manipulate the hand; (4) the adhesion of the tape to the skin of the hand decreases as the hand perspires, thereby causing the tape to slip and expose the bare hand to the rock; (5) the process of taping and untaping the hand is a time-consuming process; and (6) the tape, once removed, cannot readily be reused.

Rock climbers in cold environments have used fingerless gloves which provide protection from the cold while also allowing the climber to sense or feel the rock surface. These gloves are usually composed of a fluffy or spongy material, such as knit wool or a synthetic pile fabric, that provide insulation by trapping air in the interstices of the material. While such fingerless gloves do offer some protection from cuts, scratches, bruises and/or abrasions during climbing, they also exhibit a relatively low coefficient of friction that causes them to slip, especially during crack climbing. In addition, when using these gloves for crack climbing, the climber must generate sufficient forces by manipulation of their hand to both compress the glove material and establish sufficient frictional forces between the glove, once compressed, and the interior surfaces of the crack to allow ascension.

Also known are gloves for use in other athletic activities. For example, U.S. Pat. No. 4,411,024, which issued to Hayes on Oct. 25, 1983, discloses a glove for contact sports that utilizes a plurality of discrete foam-filled, protective protrusions to protect the back of the user's hand. The glove is attached to the user's hand using a wrist strap, finger loops and a band that extends across the palm of the user's hand. Also known are athletic gloves that pad the palm area of the user's hand using spongy, shock absorbent materials, such as foam rubber. Exemplary of such gloves are U.S. Pat. No. 3,606,614, which issued to Dimitroff on Sep. 21, 1971, and U.S. Pat. No. 4,561,122, which issued to Stanley et al., on Dec. 31, 1985. U.S. Pat. No. 4,754,499 which issued to Pirie on July 5, 1988, discloses a gripper pad that is adapted to cover the palm area of a user's hand during athletic or recreational activities. The pad is preferably made of a neoprene rubber material that aids the user in gripping an object, such as a weight-lifting bar. It is also known that surfers and divers employ gloves made of foamed rubbers, such as neoprene, for protection against the cold and to provide waterproofness. Exemplary of such a glove is U.S. Pat. No. 4,785,479, which issued to Watanabe on Nov. 22, 1988.

Gloves are also employed in various occupational activities. For instance, U.S. Pat. No. 4,675,913, which issued to Rockwell on June 30, 1987, discloses a glove for protecting the knuckles, back of hands, and back of the thumbs of an auto mechanic or other workman. The glove employs a sharkskin pad backed by rubber to protect the back of the hand. The glove is attached to the user's hand by a wrist band anchor strap having a VELCRO fastener and a plurality of elastomeric bands. The glove also includes a rubber backed sharkskin pad adapted to cover a portion of the user's palm and to said in gripping tools and the like. Also known is U.S. Pat. No. 4,742,578, which issued to Seid on May 10, 1988 for a penetration-resistant surgical glove. The surgical glove is made of a thin, resilient and elastic material such as latex.

While the gloves disclosed in the aforementioned patents do serve the purposes for which they were designed, none of these gloves specifically address the needs and problems encountered in the rock climbing environment. Consequently, there exists a need for a glove that addresses the needs and problems attendant to rock climbing.

SUMMARY OF THE INVENTION

Among the objects and advantages of the present invention are to provide a glove for rock climbing that:

(a) provides protection from cuts, scratches, bruises and abrasions during rock climbing activities;
(b) provides a secure grip between the rock climber's hand and the rock, especially during crack climbing;
(c) is flexible;
(d) is relatively hard or incompressible;
(e) is conveniently and quickly implemented, unlike, for example, hand taping which requires a lengthy application process;
(f) is reusable;

(g) provides warmth during rock climbing on cold days, while also aiding the climber's ability to ascend the rock; and (h) provides protection that aids in the act of rock climbing by reducing the pain incurred while climbing and thereby allows the rock climber to climb more enjoyably and for a longer period of time. Still further objects and advantages will become apparent from the following description and drawings.

The present invention provides a climbing glove that includes a pad made of a material that: (1) is flexible; and (2) has a coefficient of friction when engaging rock that is superior to that of human skin or tape. Preferably, the material also: (3) is relatively hard or incompressible in comparison to, for example, foamed rubbers; (4) is abrasion resistant; and (5) has a tensile strength superior to that of, for example, neoprene. A preferred material having the aforementioned characteristics is the climbing rubber used for the rands and soles of climbing shoes. The pad is adapted to cover the back of the climber's hand which is the area most susceptible to cuts, scratches, bruises and abrasions during climbing. Preferably, the pad is also adapted to cover the lower peripheral region of the climber's palm, an area that frequently comes into contact with the rock. To allow the climber to manipulate his or her hand, the central and upper portions of the palm hand are left exposed. Leaving the central and upper portions of the palm exposed also allows perspiration to evaporate. One embodiment of the glove also includes finger loops, an adjustable wrist closure, a wrist strap and a palm strap for attaching the pad to the user's hand in a manner that inhibits slippage of the pad relative to the user hand.

DETAILED DESCRIPTION OF EMBODIMENTS

Figure 1:
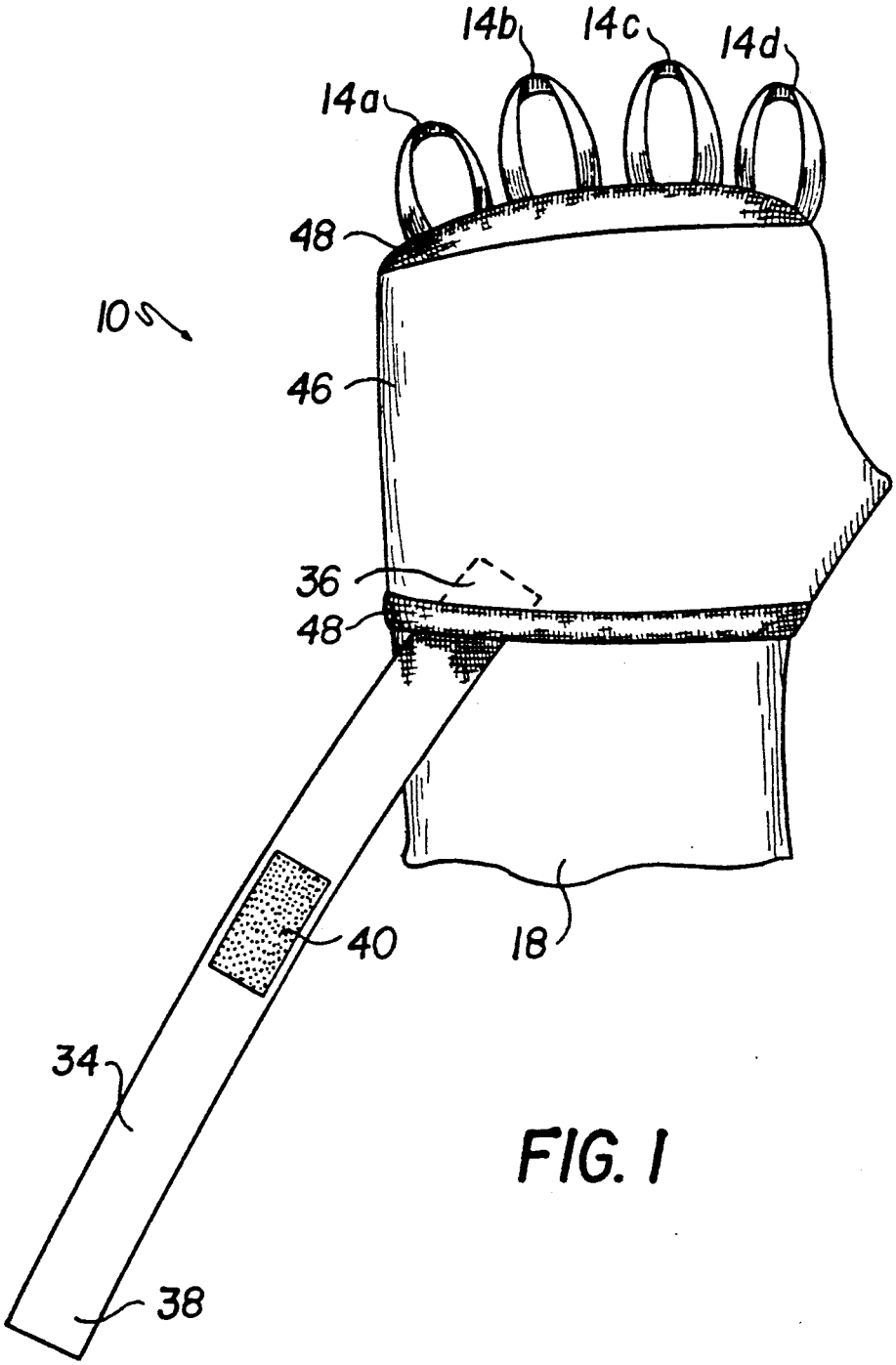
FIG. 1 is a back or dorsal view of an embodiment of the glove for rock climbing.
Figure 2:
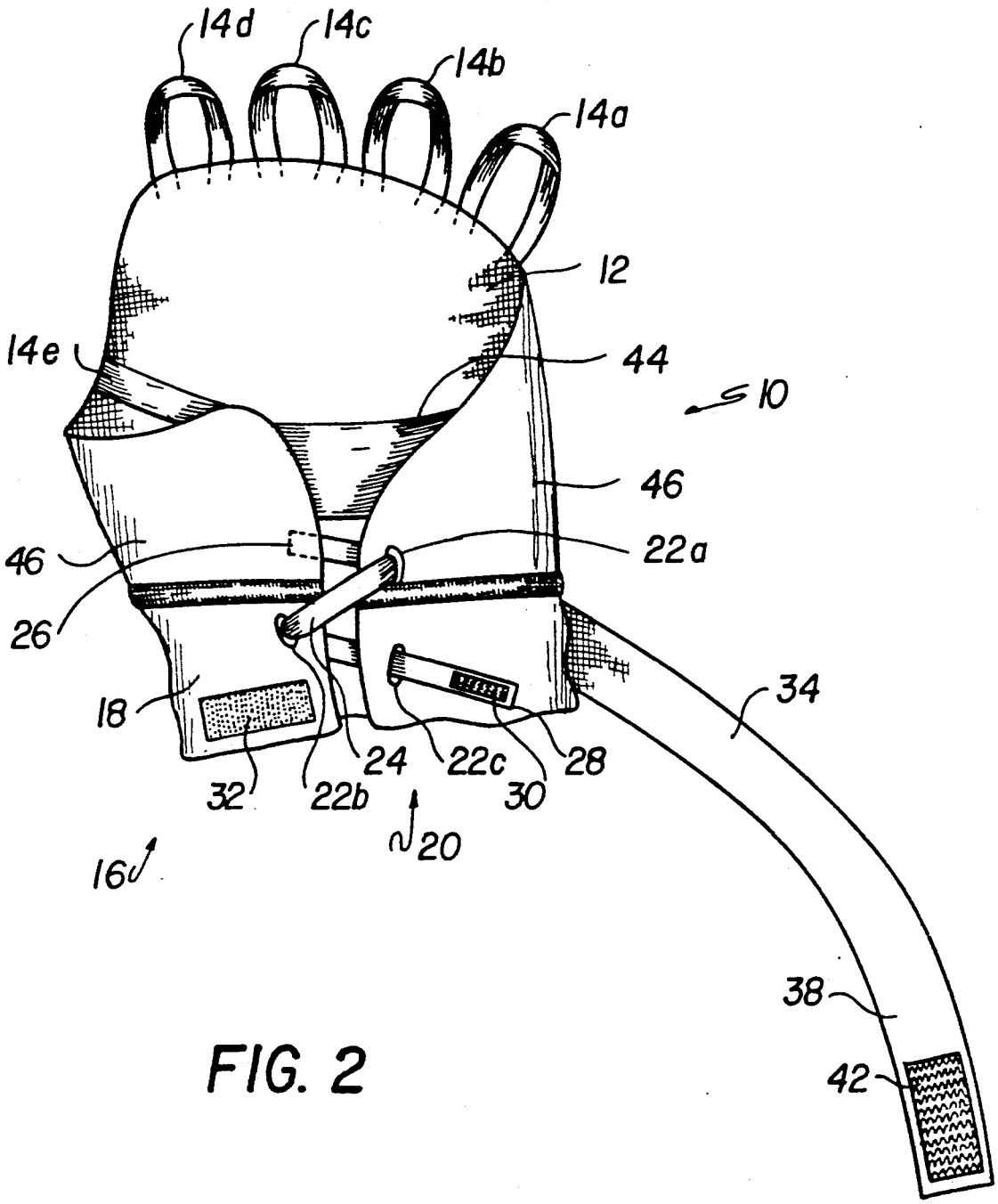
FIG. 2 is a palm or ventral view of the glove for rock climbing.
Figure 3:
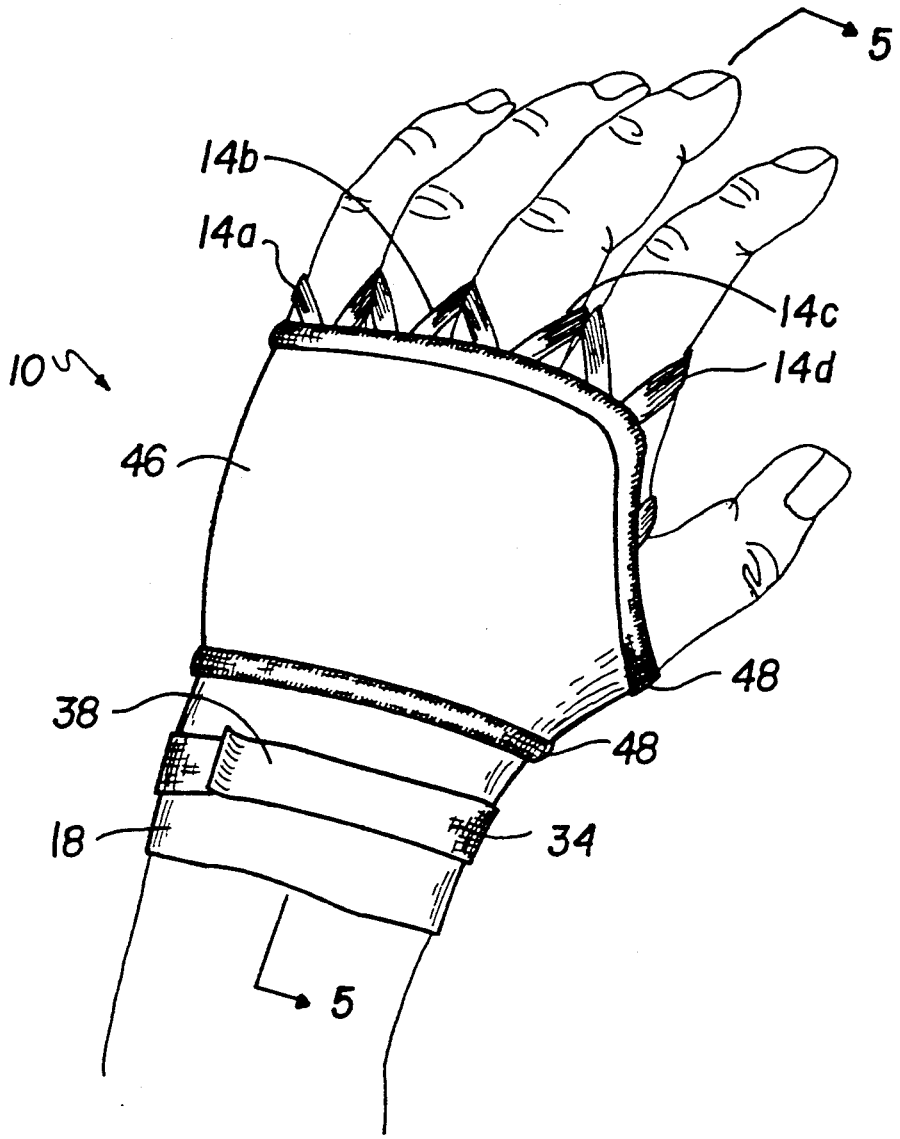
FIG. 3 is a dorsal view of the glove for rock climbing when attached to the hand of a user.
Figure 4:
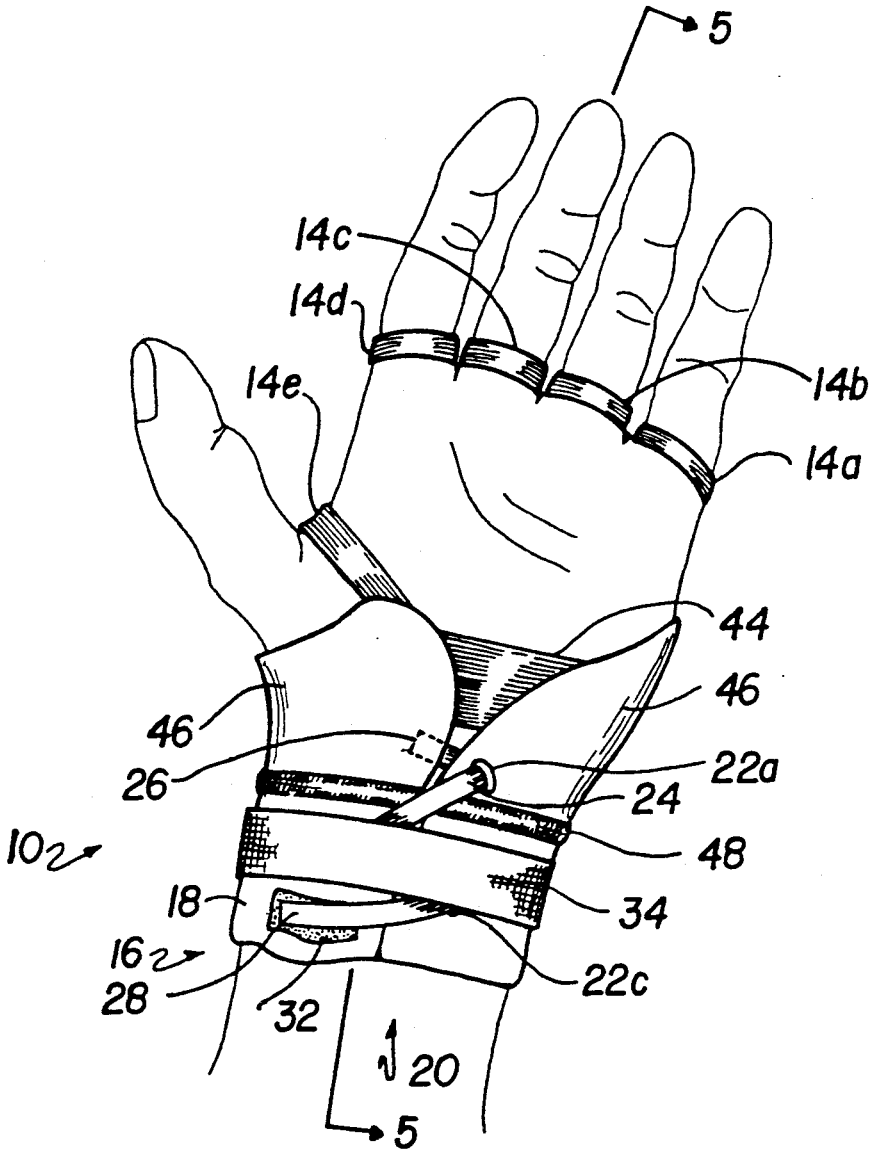
FIG. 4 is a palm or ventral view of the glove for rock climbing when attached to the user's hand.
Figure 5:
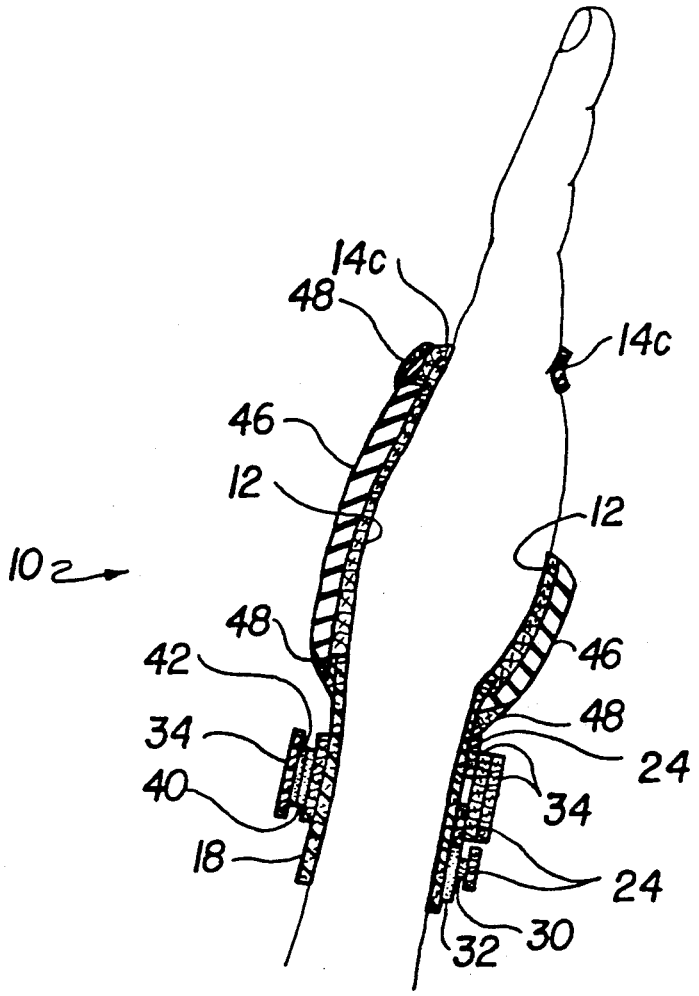
FIG. 5 is a cross-sectional view of the glove for rock climbing.

With reference to FIGS. 1-5, an embodiment of a glove for rock climbing 10, hereinafter referred to as glove 10, is illustrated. Throughout this description the following conventions are adopted: (1) the terms "upper" and "lower" refer to areas of the glove 10 that are located in the direction of the user's fingertips and forearm, respectively; (2) the terms "radial and "ulnar" refer to areas of the glove 10 that are located in the direction of the user's thumb and little finger, respectively; and (3) the terms "ventral" and "dorsal" refer to the palm and back sides of the user's hand, respectively.

The glove 10 includes a liner 12 that provides a structural framework onto which other elements of the glove 10 can be secured. The liner 12 is adapted to cover the back of the climber's hand. More specifically, the liner 12 is adapted to cover the back of the climber's hand from the radial to the ulnar sides and from a point substantially adjacent the climber's wrist to a point substantially adjacent the knuckle joints between the metacarpus and phalanges. The liner 12 is also adapted to cover the lower peripheral portions of the palm of the climber's hand. Preferably, the liner 12 covers an area extending from the radial to the ulnar sides of the climber's palm and from a point substantially adjacent the wrist upward to a point substantially adjacent the base of the thumb. Many types of natural and synthetic materials can be used to make the liner 12. Preferably, the liner 12 is made of a relatively thin, tightly woven synthetic nylon mesh that resists slippage when in contact with the skin of the user's hand. Synthetic nylon mesh also provides breathability, durability, wear resistance, elasticity, and strength. Other satisfactory materials include thin neoprene and soft calfskin. These materials, however, are not as breathable as the aforementioned tightly woven synthetic nylon mesh and may cause the liner 12 and, hence, the glove 10 to slip due to perspiration at the interface between the skin of the climber's hand and the liner 12. The method of making the liner 12 includes stitching precut patterns made from one of, or a combination of, the above mentioned materials.

Operatively connected to the liner 12 are finger loops **14*a*-14*e* which are used to attach the glove 10 to the climber's hand by insertion of the climber's fingers therethrough. The finger loops 14*a*-14*e* also serve to prevent the glove 12 from being pushed back toward the climber's wrist during, for example, insertion of the glove 10 into a crack. Preferably, the finger loops 14*a*-14*e*** are made of an elastomeric material that allows fingers of varying dimensional characteristics to be accommodated.

The glove 10 also includes an inside wrist band assembly 16 that is adapted to receive the climber's wrist and thereby further attach the glove 10 to the climber's hand. The inside wrist band assembly 16 also serves to prevent the glove 10 from slipping upward towards the climber's fingers when, for example, the glove 10 is withdrawn from a crack. The inside wrist band assembly 16 includes a band 18 that is attached to the liner 12 and preferably made of suede leather. Also included in the inside wrist band assembly 16 a lacing system 20 for adjusting the fit of the band 18 about the climber's wrist. The lacing system 20 also facilitates application and removal of the glove 10 from the climber's hand. The lacing system 20 includes holes **22*a*-22*c* extending through the band 18, liner 12 and a rubber pad. Preferably, a single lace 24 having a fixed end 26 attached to the liner 12 and a free end 28 that extends through the holes 22*a*-22*c* in an alternating fashion is employed to allow single handed adjustment of the inside wrist band assembly 16. A fastener is used to hold the lace 24 and, hence, the ends of the band 18 at a desired position. Preferably the fastener includes a first tab 30 of VELCRO material attached to the free end 28 of the strap and a second tab 32 of VELCRO material attached to the strap 18. The use of VELCRO or other similar materials facilitates single handed adjustment of the inside wrist band assembly 16**.

While the inside wrist band assembly 16 does serve to prevent the glove 10 from slipping upward towards the climber's fingertips, the glove 10 also includes an outside wrist strap 34 for further preventing such slippage. The outside wrist strap 34 includes a first end 36 and a second end 38. The first end 36 is attached to the lower, dorsal, ulnar side of the liner 12 while the second end 38 is free to wrap around the climber's wrist. Preferably, the outside wrist strap 34 is made of a flat, flexible, inelastic material, such as nylon. The outside wrist strap 34 also includes a fastener that allows it to be fixed at a desired tension. Preferably, the fastener includes a third tab 40 of VELCRO material located intermediate to the first and second ends 36, 38, of the outside wrist strap 34 and a fourth tab 42 of VELCRO material located substantially adjacent the second end 38 of the outside wrist strap 34. Again, the use of VELCRO or other materials with similar properties facilitates the single handed adjustment of the outside wrist strap 34. In operation, the second end 38 of the outside wrist strap 34 is wrapped around the climber's wrist and preferably overlies the band 18. Once a desired tension is achieved the fourth tab 42 is brought into contact with the third tab 40 to fix the outside wrist strap 34 in place.

While the finger loops 14*a*–14*e*, the inside wrist band assembly 16 and the outside wrist strap 34 serve to prevent the glove 10 from slipping downward and upwards over the climber's hand, they also serve to prevent slippage of the glove 10 in the radial and ulnar directions. To further prevent such slippage, however, the glove 10 includes a palm strap 44 that is attached to the radial and ulnar sides of the ventral side of the liner 12. The palm strap 44 operates to tension the radial side of the glove 10 against the ulnar side of the glove 10 and thereby prevent slippage in the radial and/or ulnar directions. Preferably, the palm strap 44 is made of an elastomeric material so that tension is maintained even when, for example, the climber's thumb is brought across the palm and toward the little finger.

The glove 10 also includes a pad 46 for, among other things, providing protection for the hand during rock climbing. The pad 46 is attached to the liner 12 and is substantially co-extensive therewith. More specifically, the pad 46 extends from the radial to the ulnar sides of the back of the hand and from the lower part of the back of the hand substantially adjacent the wrist to the upper part of the back of the hand substantially adjacent the joint between the metacarpus and phalanges or fingers. The pad 46 also covers a lower portion of the palm of the climber's hand extending from the radial to ulnar sides of the palm and from a point substantially adjacent the wrist upward to a point at approximately the base of the thumb. The central and upper portions of the palm of the climber's hand are preferably exposed to facilitate evaporation of perspiration which can cause the climber's hand to slip during climbing. The central and upper portions of the climber's hand are also left exposed to allow the climber to manipulate their hand to accommodate cracks of varying sizes. For example, the climber may have to bring their thumb across the palm of the hand to fit what is known as a "hand" size crack. Similarly, the climber may have to curl their fingers toward the wrist when climbing what are known as "fist" size cracks. If the pad 46 were to cover the central and upper portions of the palm of the climber's hand such manipulations could be inhibited.

Figure 6:
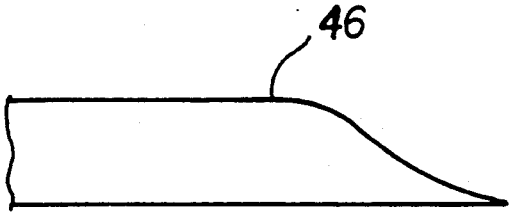
FIG. 6 is a cross-sectional view of the tapered leading edge of the rubber pad employed in the glove for rock climbing.

FIG. 6 is a cross-sectional illustration of the pad 46 which is preferably 2.03 −0.38 mm thick and includes a tapered edge to facilitate insertion and extraction of the glove 10 from cracks. The glove also includes an edge strip 48 which overlies the tapered edge of the pad 46 and serves to prevent the tapered edge of the rubber pad from being "peeled up" or detached from the liner 12 during insertion and extraction of the glove 10 from cracks.

The pad 46 is made from a material that: (1) is flexible; and (2) provides a superior coefficient of friction relative to human skin or tape. Preferably, the material also: (3) is hard or substantially incompressible relative to foamed rubbers and the like; (4) is abrasion resistant; and (5) possesses a tensile strength superior to that of, for example, the flexible neoprene rubber used in things like scuba diving gloves. The hard character of the pad 46 protects the climber's hand from cuts, scratches, bruises and/or abrasions. Moreover, the hard nature of the pad 46 facilitates transmission of forces between the climber's hand and the rock. More specifically, when a climber is ascending a crack, for example, the normal forces produced by the climber manipulating his or her hand are transmitted to the rock with little attenuation due to the hard nature of the pad 46. The normal forces, in turn, produce the frictional forces necessary to ascend the crack. In contrast, foamed rubbers and other similar materials must first be compressed before any substantial amount of force can be transmitted. Preferably, the pad 46 has a hardness greater than 40 units and preferably in the range extending from 40 to 90 units on the Shore A durometer scale. The flexible character of the pad 46 allows the climber to manipulate his or her hand and accommodates the irregular rock surfaces encountered during climbing. Climbing and especially crack climbing are made easier by the superior coefficient of friction the pad 46 possesses relative to human skin. More specifically, the frictional force necessary to ascend a rock is achieved with less of the normal forces provided by climber because of the superior coefficient of friction of the pad 46 relative to human skin or tape. One measure of the coefficient of friction that is particularly relevant to climbing is the breakaway friction test described in Reno, *Charles Cole Talks About Rubber*, 24 Rock & Ice, 54–56 (1988) which is incorporated herein by reference. Preferably, the material has a breakaway friction greater than about 30–35 pounds. The abrasion resistant quality of the pad 46 insures that it will not wear out too quickly. The relatively high tensile strength of the pad 46 resists tearing and, hence, reduces the likelihood that the glove 10 will slip when, for example, it is being used for crack climbing. The preferred materials having these qualities are the types of rubber used for the soles and rands of rock climbing shoes, hereinafter referred to as climbing rubber. Exemplary of rock climbing shoes that employ climbing rubber are those sold under the names of LA SPORTIVA, FIRE, ASOLO and SCARPA. Climbing rubber is available in sheets from the 5.10 Company, P.0. Box 1390, Glendale, Calif. and La Sportiva U.S.A., 1335 Broadway, Boulder, Col.

In operation, the glove 10 is put on the user's hand by slipping the hand through the strap 18 and inserting the fingers through the finger loops 14*a*–14*e*. The fit of the glove 10 is then adjusted using the lacing system 20. Once the lacing system 20 is secured using the first and second tabs, 30, 32, the second end 38 of the outside wrist strap 34 is wrapped about the user's wrist and fixed in place using the third and fourth tabs 40, 42. The finger loops 14*a*–*e*, the inside wrist band assembly 16, the outside wrist strap 34 and the palm strap 44 individually and in combination with one another serve to attach the glove to the user's hand and prevent the glove 10 from slipping on the user's hand.

Figure 7A:
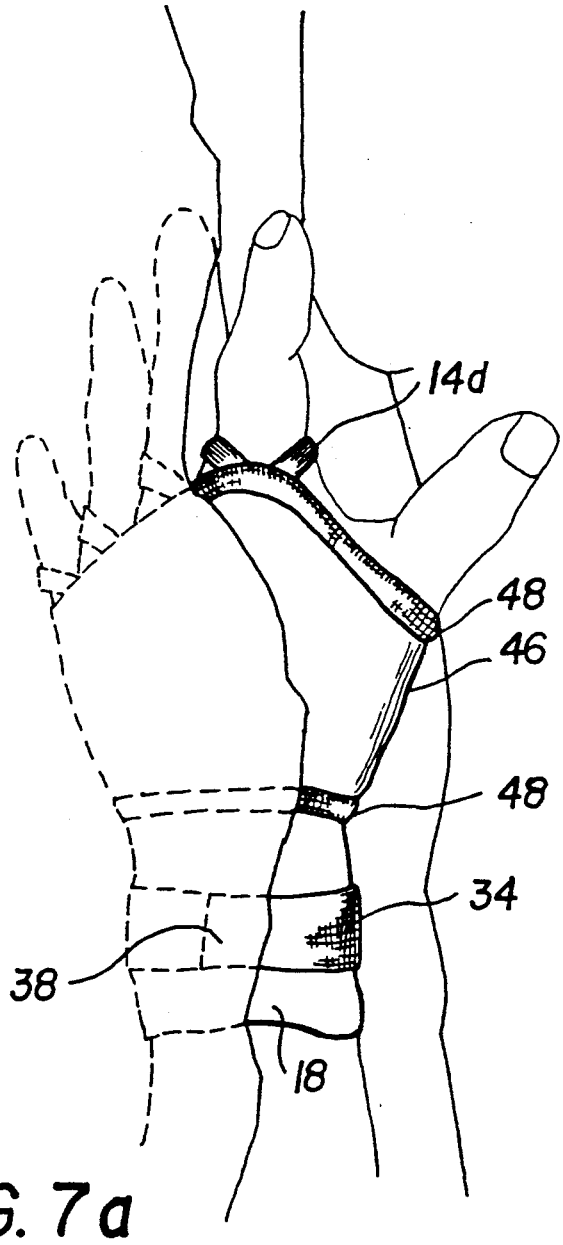
FIGS. 7A and 7B are perspective views that illustrate the relationship between the glove for rock climbing and the interior surfaces of a crack.
Figure 7B:
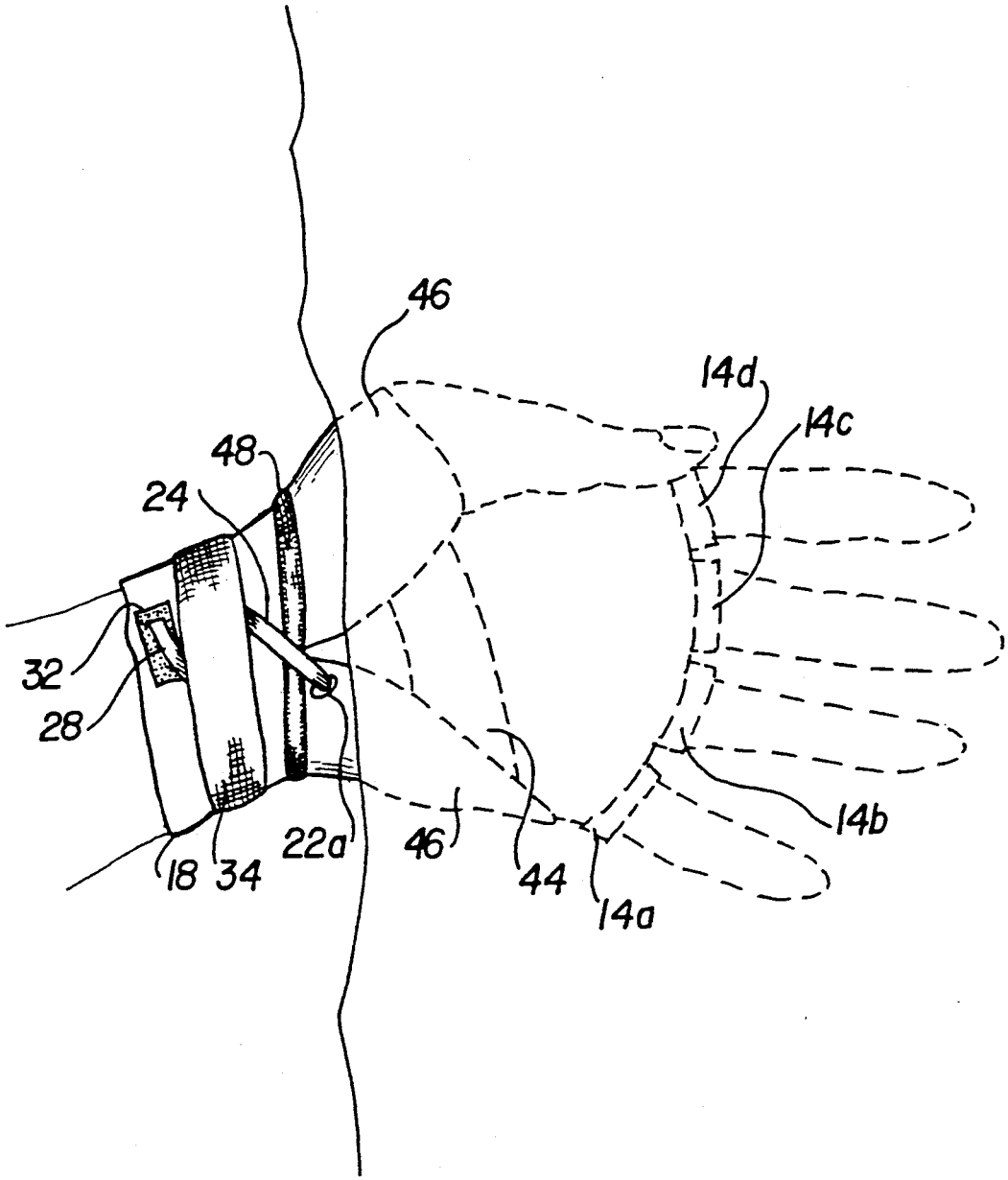

FIGS. 7A-7B illustrate the operation of the glove 10 when used to ascend a "hand" size rack. When ascending a "hand" size crack, the climber manipulates his or her hand to form what is known as a "hand jam". the "hand jam" involves the following sequence: (1) the hand is inserted into the crack with the fingers straight and the thumb positioned in the plane of the hand; and (2) the heel and tip of he thumb are rotated toward the little finger thereby expanding the hand within the crack and creating normal forces between the interior surfaces o the crack and th back and palm surfaces of the climber's hand. These normal forces, in turn, create frictional forces that allow the climber to ascent the crack. As illustrated in FIGS. 7A and 7B, the pad 46 of the glove 10 protects the climber s hand. Also, the glove 10 allow the climber to more easily ascend the crack due to various properties of the climbing rubber preferably employed to make the pad 46. Moreover, by leaving the central and upper areas of the climber's palm exposed, the gtlove 10 does not substantially interfere with the climber's manipulation of his or her hand and also allows perspiration to evaporate.

An alternative embodiment of the glove 10 is made using molding technique. For instance, the glove 10 can be made using injection molding technology where a liquefied material, such as a liquefied climbing rubber, is injected into an appropriately configured mold. The glove 10 can also be made by directly applying a liquidified material to a model of a hand. The mold can be configured such that the resulting glove is adapted to leave the aforementioned and/or illustrated areas of the climber's hand, such as the central palm and/or fingers, exposed. Alternatively, the material can be applied to the mold in a manner that produces a glove which leaves one or more of these areas of the climber's hand exposed. A single-piece glove 10 can be realized using molding techniques if the material has a relatively high elasticity, like the material employed is surgical gloves, in addition to having some or all of the aforementioned properties. If, however, such a material is not available, then finger loops, a wrist hand, a lacing system, palm strap and/or wrist strap can be attached to an appropriately configured pad made from, for example, a climbing rubber and shaped by a molding technique.

Several modifications of the glove 10 are possible. For instance, the pad 46 could be modified to cover only the back of the hand which, due to its bony nature, is more susceptible to cuts, scratches, bruises and/or abrasions than the palm. The pad 46 can also be modified to cover portions of the wrist. In addition, the pad 46 can be modified to cover other peripheral areas of the climber's palm.

Figure 8:
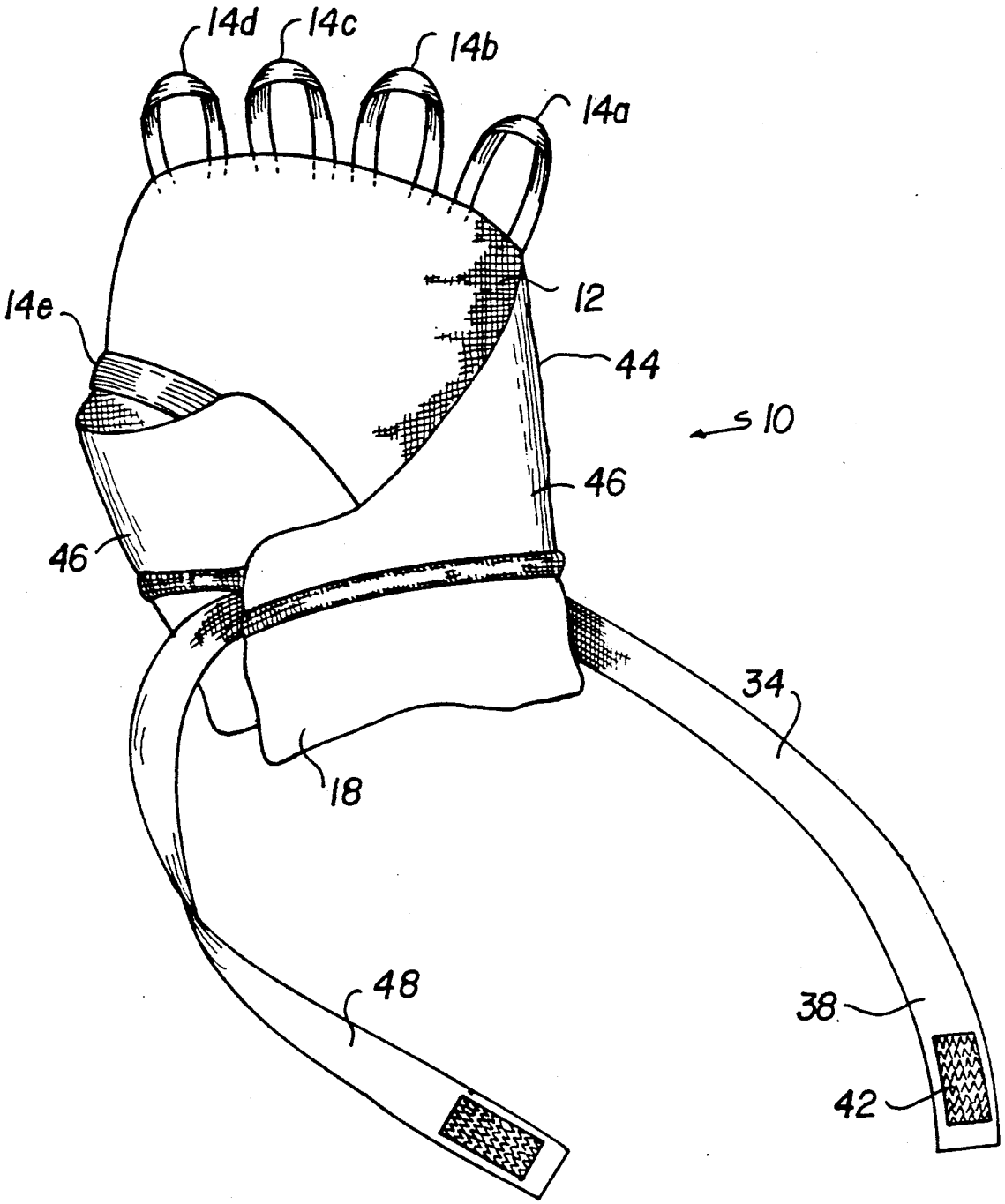
FIG. 8 illustrates an alternative embodiment of the glove for rock climbing.

FIG. 8 illustrates an alternative embodiment of the glove 10 that does not use a lacing system. Rather, the alternative glove 10 employs a strap 48 to close the pad 46 over the lower peripheral palm portion of the climber's hand. Preferably, a tab of VELCRO material attached to the distal end of the strap 48 and a cooperating tab of VELCRO material attached to the proximal end of the strap 48 are used to fasten the strap 48.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternative embodiments to the extent permitted by the prior art.

What is claimed is:

1. A glove for use in rock climbing, comprising:
a paid made from a rubber material that is flexible and has a breakaway friction greater than about 30 to 35 pounds, wherein at least a portion of said pad is exposed for use in contacting a rock surface when e glove is used in lock climbing.

2. A glove, as claimed in claim 1, wherein:
said material is at least one of the following: (1) substantially incompressible; (2) abrasion resistant; and (3) has a tensile strength greater than that of neoprene.

3. A glove for use in rock climbing, comprising:
a pad made from climbing rubber that is flexible and has a breakaway friction greater than about 30 to 35 pounds, wherein at least a portion of said pad is exposed for use in contacting a rock surface when the glove is used in rock climbing.

4. A glove, as claimed in claim 3 wherein:
said pad is adapted to leave the central portion of a climber's palm exposed.

5. A glove, as claimed in claim 3, wherein:
said pad is adapted to leave at least one of a climber's fingers exposed.

6. A glove, as claimed in claim 3, wherein:
said pad is adapted to cover only the back of a climber's hand.

7. A glove, as claimed in claim 3, wherein:
said pad is adapted to cover only the back and lower peripheral palm areas of a climber's hand.

8. A glove, as claimed in claim 3, wherein:
said pad having a tapered edge.

9. A glove, as claimed in claim 8, further including:
an edge strip covering said tapered edge of said pad.

10. A glove for use in rock climbing, comprising:
a pad made from climbing rubber that is flexible and has a breakaway friction greater than about 30 to 35 pounds; and
means or attaching said pad to a climber's hand;
wherein at least a portion of said pad is exposed for use in contacting a rock surface when the glove is used in rock climbing.

11. A glove, as claimed in claim 10, wherein: said means for attaching includes lacing means for adjusting the fit of the glove.

12. A glove, as claimed in claim 10, wherein: said means for attaching including a single lace for adjusting the fit of the glove.

13. A glove for use in rock climbing, comprising:
a pad adapted to leave the central portion o the climber's palm exposed, wherein said pad is made from a rubber material that is flexible and has a breakaway friction greater than about 30 to 35 pounds and at least a portion of said pad is exposed for use in contacting a rock surface when the glove is used in rock climbing.

14. A glove, as claimed in claim 13, wherein:
said rubber material includes climbing rubber.

15. A glove for use in rock climbing, comprising:
a pad adapted to leave at least one of a climber's fingers exposed, wherein said pad is made from climbing rubber that is flexible and has a breakaway friction greater than about 30 to 35 pounds and at least a portion of said pad is exposed for use in contacting a rock surface when the glove is used in rock climbing.

16. A glove for use in rock climbing, comprising:
a pad adapted to cover only the back of a climber's hand, wherein said pad is made from a hard rubber that is flexible and has a breakaway friction greater than about 30 to 35 pounds, and at least a portion of said pad is exposed for use in contacting a rock surface when the gtlove is used in rock climbing.

17. A glove, as claimed in claim 16, wherein:
said hard rubber is substantially incompressible.

18. A glove, as claimed in claim 16, wherein:, said hard rubber has hardness greater than about 40 units on the Shore A durometer scale.

19. A glove for use in rock climbing, comprising:
a pad for covering only the back and lower peripheral palm areas of a climber's hand, wherein said pad is made from a rubber material that is flexible and has a breakaway friction greater than about 30 to 35 pounds and at least a portion of said pad is exposed for use in contacting a rock surface when the glove is used in rock climbing.

20. A glove, as claimed in claim 19, wherein:
said pad is made from a climbing rubber.

21. A glove for use in rock climbing, comprising:
a pad made from a climbing rubber that is flexible and has a breakaway friction greater than about 30 to 35 pounds, and adapted to cover the back and lower peripheral palm areas of a climber's hand, said pad having a tapered edge and at least a portion of said pad is exposed for use in contacting a rock surfrace when the glove is used in rock climbing;
an edge strip covering said tapered edge;
a plurality of finger loops operatively attached to said pad;
an adjustable wrist band operatively attached to said pad, said adjustable wrist band including a lacing device; and
a wrist strap operatively attached to said pad.

* * * * *